US006371688B1

(12) United States Patent
Yang et al.

(10) Patent No.: US 6,371,688 B1
(45) Date of Patent: Apr. 16, 2002

(54) MANHOLE COVER MOUNTING STRUCTURE

(76) Inventors: Ya-Yun Yang; Chih-Cheng Yang; Chi-Chih Yang, all of 10th-2 Floor, No.302, Sec.2, Li Ming Road, Taichung City (TW)

( * ) Notice: Subject to any disclaimer, the term of this patent is extended or adjusted under 35 U.S.C. 154(b) by 0 days.

(21) Appl. No.: 09/801,823

(22) Filed: Mar. 9, 2001

(51) Int. Cl.[7] ..... E02D 29/14
(52) U.S. Cl. ..... 404/26; 52/20; 404/25
(58) Field of Search ..... 404/25, 26; 52/19, 52/20; 220/3.9, 4.03

(56) References Cited

U.S. PATENT DOCUMENTS 5,344,253 A * 9/1994 Sacchetti ..... 404/26
5,628,152 A * 5/1997 Bowman ..... 52/20
5,974,741 A * 11/1999 Fukuhara ..... 52/20
6,007,270 A * 12/1999 Bowman ..... 404/25
6,036,401 A * 3/2000 Morina et al. ..... 404/26

* cited by examiner

*Primary Examiner*—Gary S. Hartmann
(74) *Attorney, Agent, or Firm*—Rosenberg, Klein & Lee

(57) ABSTRACT

A manhole cover mounting structure includes an outer frame fastened to a manhole box by screw bolts, the outer frame having an upright guide rod in each of a plurality of hollow peripheral locating blocks thereof, an inner frame adjustably fastened to the inner frame to hold a cover plate in flush with the road surface. The inner frame has a plurality of female screws fastened to peripheral lugs thereof to hold a respective hollow screw rod for the mounting of through bolts; thereby securing to secure the inner frame to the upright guide rod in each locating block of the outer frame.

3 Claims, 10 Drawing Sheets

MANHOLE COVER MOUNTING STRUCTURE

BACKGROUND OF THE INVENTION

1. Field of the Invention

The present invention relates to a manhole and, more specifically, to a manhole cover mounting structure that can be conveniently adjusted to lift the elevation of the inner frame thereof when sank under the load, keeping the cover plate in flush with the road surface.

2. Description of the Prior art

In underground piping construction, a manhole or hand-hold box is provided in the road surface through which a worker or the hand can enter the water conduit to install a piping system or make a repair work. FIGS. 1 and 2 show a manhole box mounting structure according to the prior art. The manhole box mounting structure comprises a manhole box 1, a frame 11 on the manhole box and embedded with the manhole box 1 in reinforcing concrete RC, and a cover plate 12 covered in the frame 11. This structure of manhole cover mounting structure has drawbacks as follows:

1. After the manhole box 1 embedded in the ground, the frame 11 is not maintained in flush with the road surface, and pebbles 13 are used to support the frame 11 above the manhole box 1 and to keep the frame 11 in flush with the road surface, and then reinforcing concrete RC is applied to fix the frame 11 and the manhole box 1to the ground. Because the color of applied reinforcing concrete RC does not fit the color of the asphalt AC of the road surface, it destroys the sense of beauty of the road surface.

2. If the frame 11 sinks under the load of vehicles passed, reinforcing concrete RC must be removed so that the elevation of the frame 11 can be adjusted to hold the cover plate 12 in flush with the road surface. This elevation adjusting procedure is complicated.

There are known manhole cover mounting structures in which the cover plate can be adjusted vertically relative to the frame and the manhole box. However, because the elevation of the frame is not adjustable, the adjustment of the cover plate is limited to a narrow range.

SUMMARY OF THE INVENTION

The present invention has been accomplished to provide a manhole cover mounting structure, which eliminates the aforesaid drawbacks. It is one object of the present invention to provide a manhole cover mounting structure, which can conveniently be adjusted to the desired elevation, keeping the cover plate in flush with the road surface. It is another object of the present invention to provide a manhole cover mounting structure, which fits manholes of any of a variety of shapes. It is still another object of the present invention to provide a manhole cover mounting structure, which stable and durable in use. It is still another object of the present invention to provide a manhole cover mounting structure, which can be adjusted at a single side or single point subject to the sloping condition of the road surface. To achieve these and other objects of the present invention, the manhole cover mounting structure of the present invention comprises a manhole box, the manhole box having a plurality of screw nuts fixedly provided at a top side thereof; an outer frame fixedly fastened to screw nuts of the manhole box by screw bolts; an inner frame mounted in said outer frame; and a cover plate covered on the inner frame in flush with the topmost edge of the inner frame; wherein: the outer frame comprises a plurality of locating blocks disposed around the periphery thereof, the locating blocks each comprising a top-open hollow body and an upright guide rod disposed in the hollow body, the upright guide rod having an axially upwardly extended screw hole; the inner frame comprises a plurality of lugs spaced around the periphery thereof corresponding to the locating blocks of the outer frame, the lugs each having a through hole, a plurality of female screws respectively fixedly fastened to the lugs at a bottom side and axially aligned with the through hole of each of the lugs, and a plurality of screw rods respectively threaded into the female screws, the screw rods each having an axially extended, stepped through hole formed of an upper polygonal hole and a lower coupling hole, which receives the upright guide rod of each of the locating blocks of the outer frame; a plurality of through bolts are respectively inserted into the upper polygonal hole and lower coupling hole of each screw rod at each of the lugs of the inner frame and threaded into the screw hole of the upright screw rod of each of the locating blocks of the outer frame to secure the inner frame to the outer frame.

DETAILED DESCRIPTION OF THE PREFERRED EMBODIMENT

Figure 1:
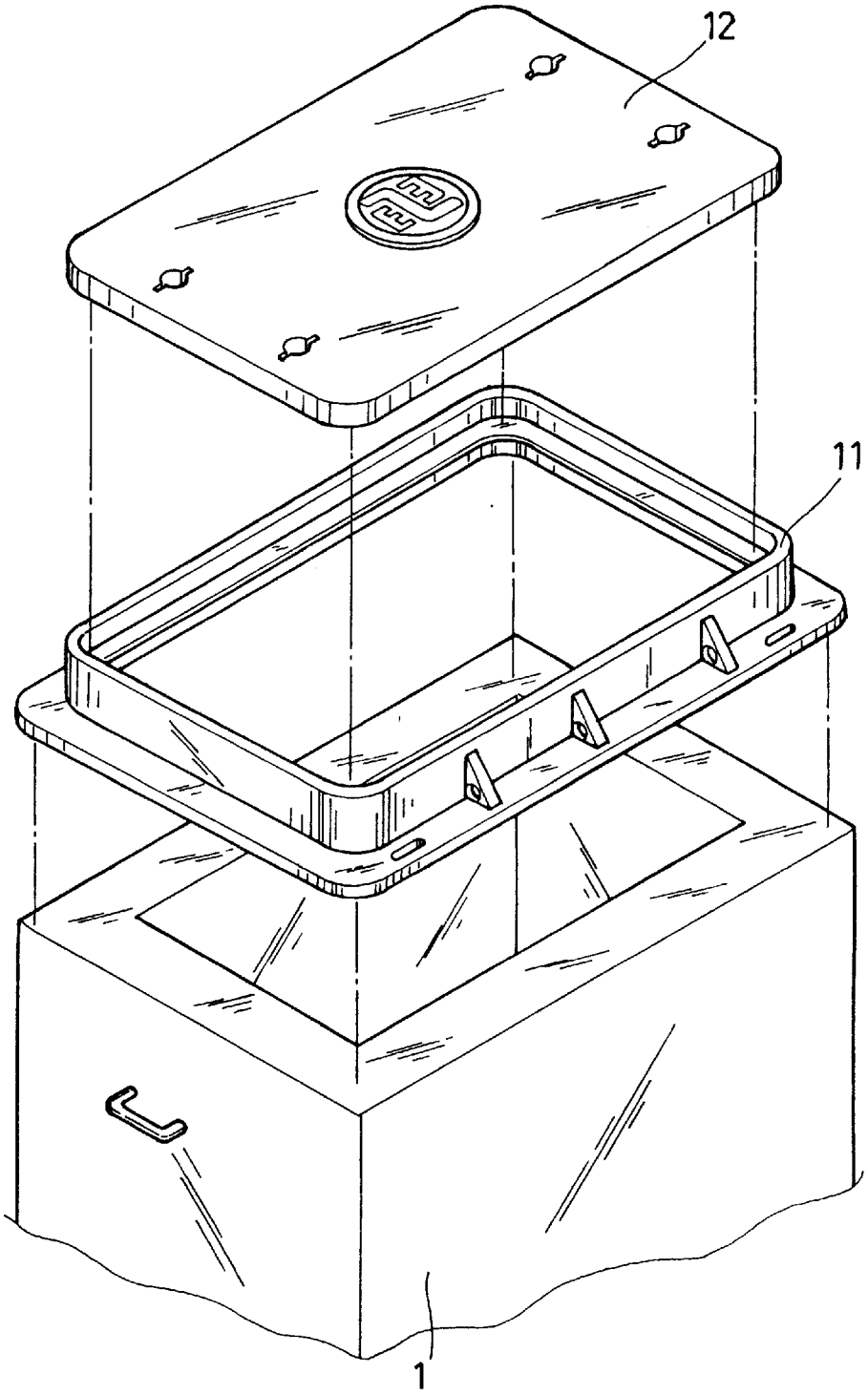
FIG.1 PRIOR ART
FIG. 1 is an exploded view of a manhole cover mounting structure according to the prior art.
Figure 2:
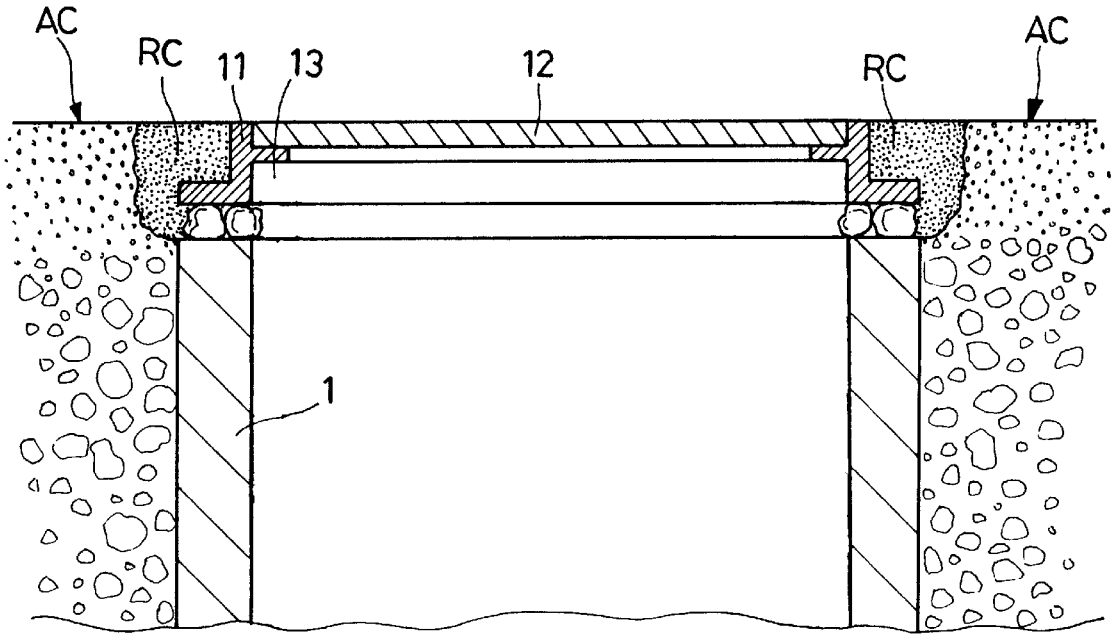
FIG. 2 PRIOR ART
FIG. 2 illustrates the prior art manhole cover mounting structure installed.
Figure 3:
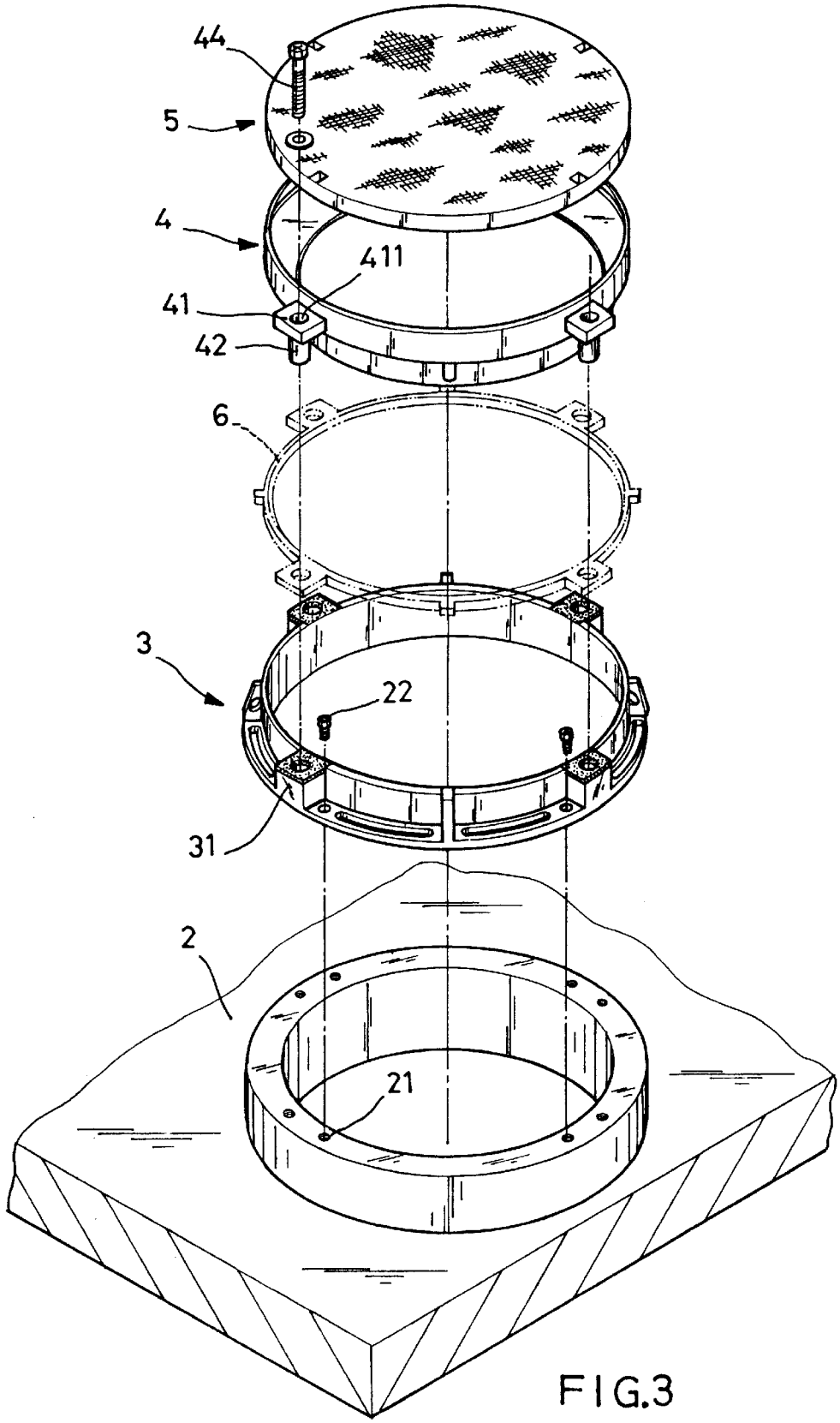
FIG. 3 is an exploded view of a manhole cover mounting structure according to the present invention.
Figure 4:
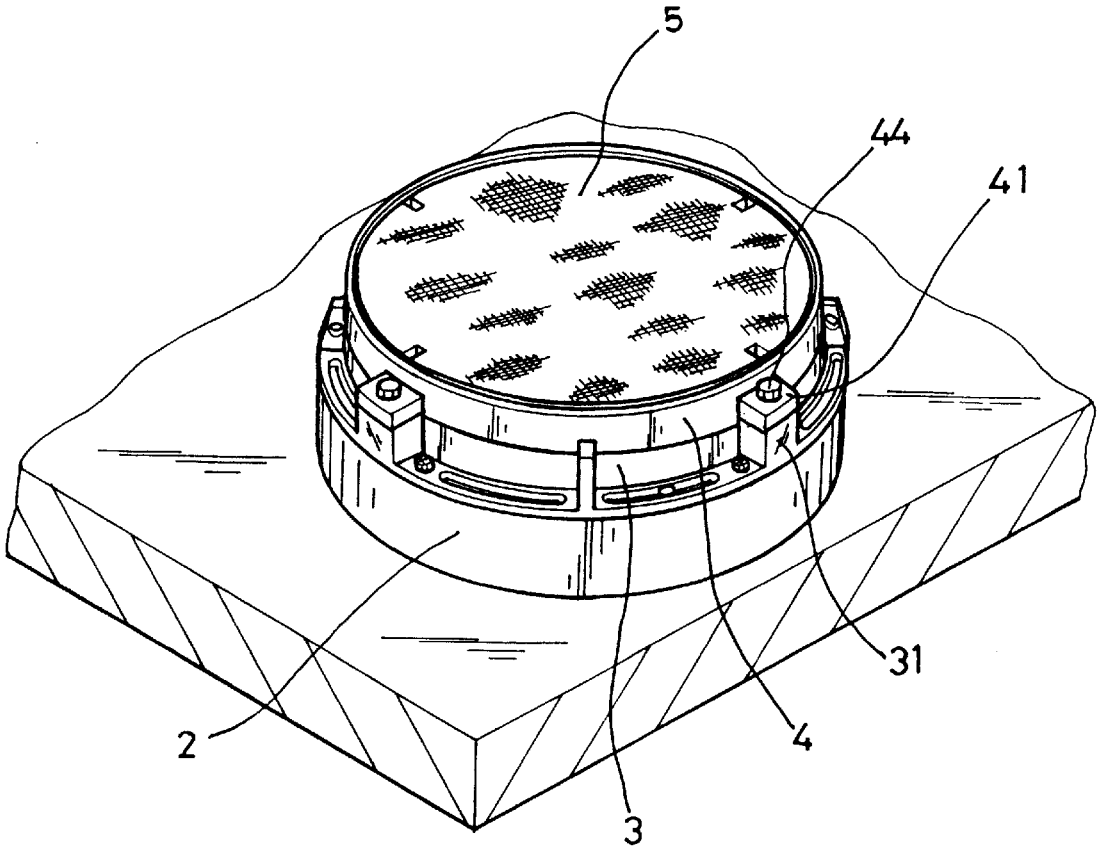
FIG. 4 is an elevational view of the manhole cover mounting structure according to the present invention.
Figure 5:
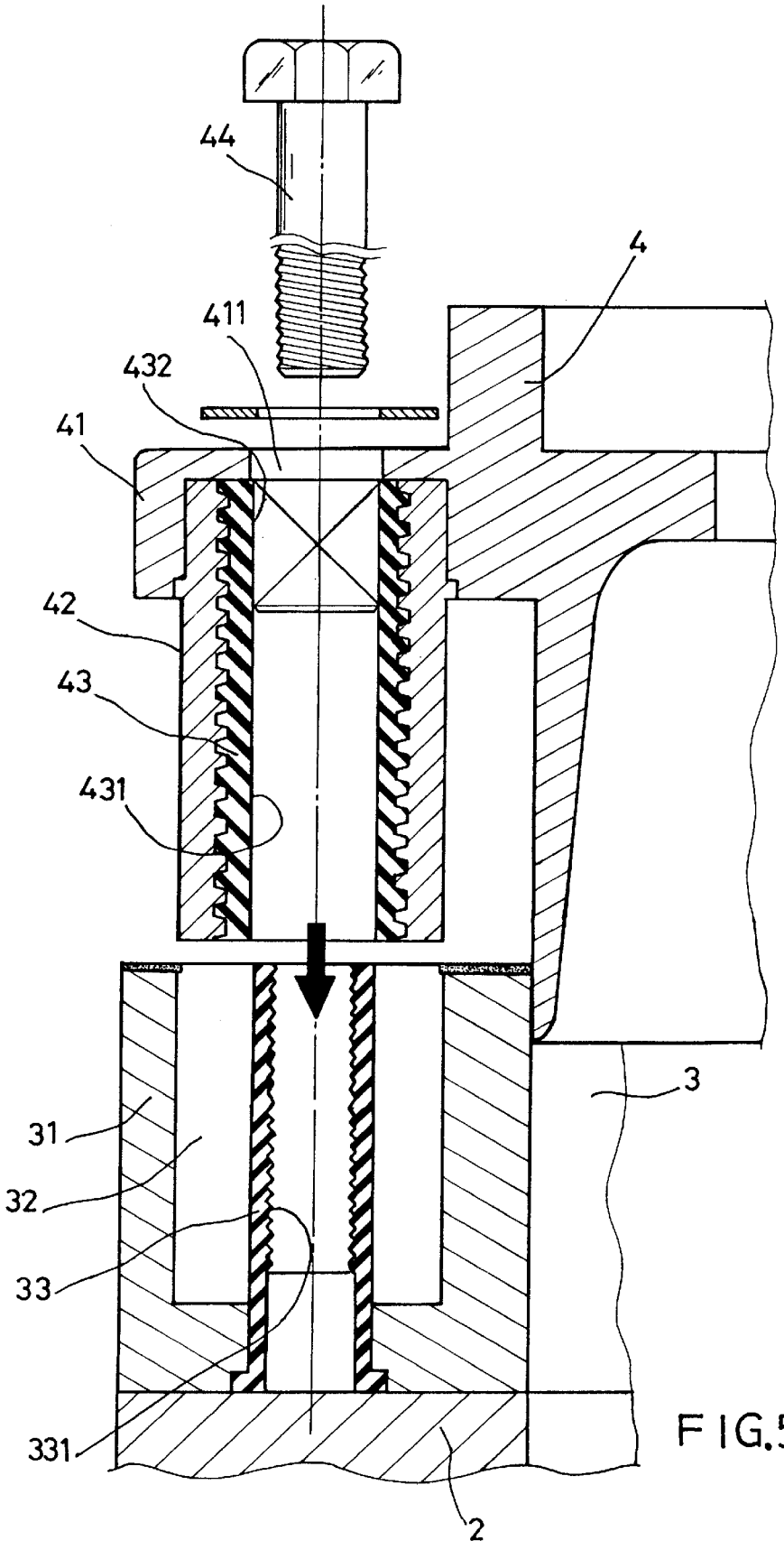
FIG. 5 is a sectional view showing the connection between the outer frame and the inner frame according to the present invention.
Figure 6:
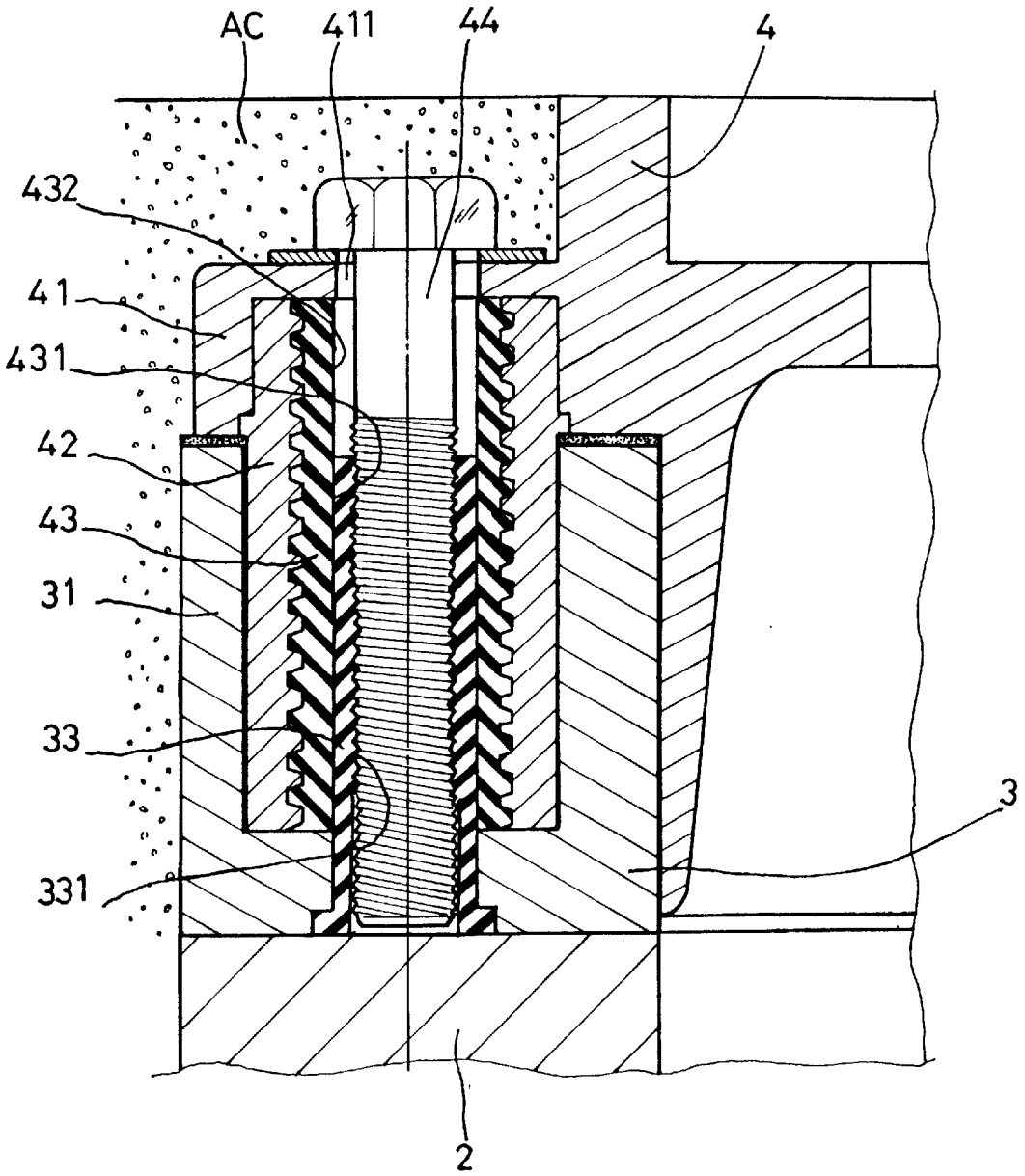
FIG. 6 is a sectional view of a part of the present invention, showing the manhole cover mounting structure installed.

Referring to FIGS. 3, 4 and 5, a manhole cover mounting structure in accordance with the present invention comprises:

a manhole box 2, the manhole box 2 having screw nuts 21 fixedly provided at the topside thereof;

an outer frame 3 fixedly fastened to the screw nuts 21 of the manhole box 2 by screw bolts 22;

an inner frame!4 mounted in the outer frame 3; and a cover plate 5 covered on the inner frame 4 in flush with the topmost edge of the inner frame 4;

wherein the outer frame 3 comprises a plurality of locating blocks 31 disposed around the periphery, each locating block 31 comprising a top-open hollow body 32 and an upright guide rod 33 having an axially upwardly extended screw hole 331;

the inner frame 4 comprises a plurality of lugs 41 spaced around the periphery corresponding to the locating blocks 31 of the outer frame 3, each lug 41 having a through hole 411, a plurality of female screws 42 respectively fixedly fastened to the lugs 41 at the bottom side and axially aligned with the respective through hole 411, and a plurality of screw rods 43 respectively threaded into the female screws 42, each screw rod 43 having an axially extended, stepped through hole formed of an upper polygonal hole 432 and a lower coupling hole 431, which receives the upright guide rod 33 of the corresponding locating block 31;

a plurality of through bolts 44 are respectively inserted into the upper polygonal hole 432 and lower coupling hole 431 of each screw rod 43 at each of the lugs 41 and threaded into the screw hole 331 of the upright screw rod 33 of each of the locating blocks 31 of the outer frame 3.

Referring to FIGS. from 5 through 7, after connection of the outer frame 3 to the manhole box 2, the female screws 42 of the inner frame 4 are respectively inserted into the top-open hollow body 32 of each locating block 31 of the outer frame 3, keeping the lower half of each screw rod 43 sleeved onto the corresponding upright guide rod 33, and then the through bolts 44 are respectively inserted through the through hole 411 on each lug 41 of the inner frame 4 and the stepped through hole of the upper polygonal hole 432 and the lower coupling hole 431 of each screw rod 43 and threaded into the screw hole 331 of the upright guide rod 33 of each locating block 31 to secure the inner frame 4 to the outer frame 3, and then asphalt AC is covered on the manhole box 2 around the outer frame 3 and the inner frame 4, and thus the installation is done.

Figure 7:
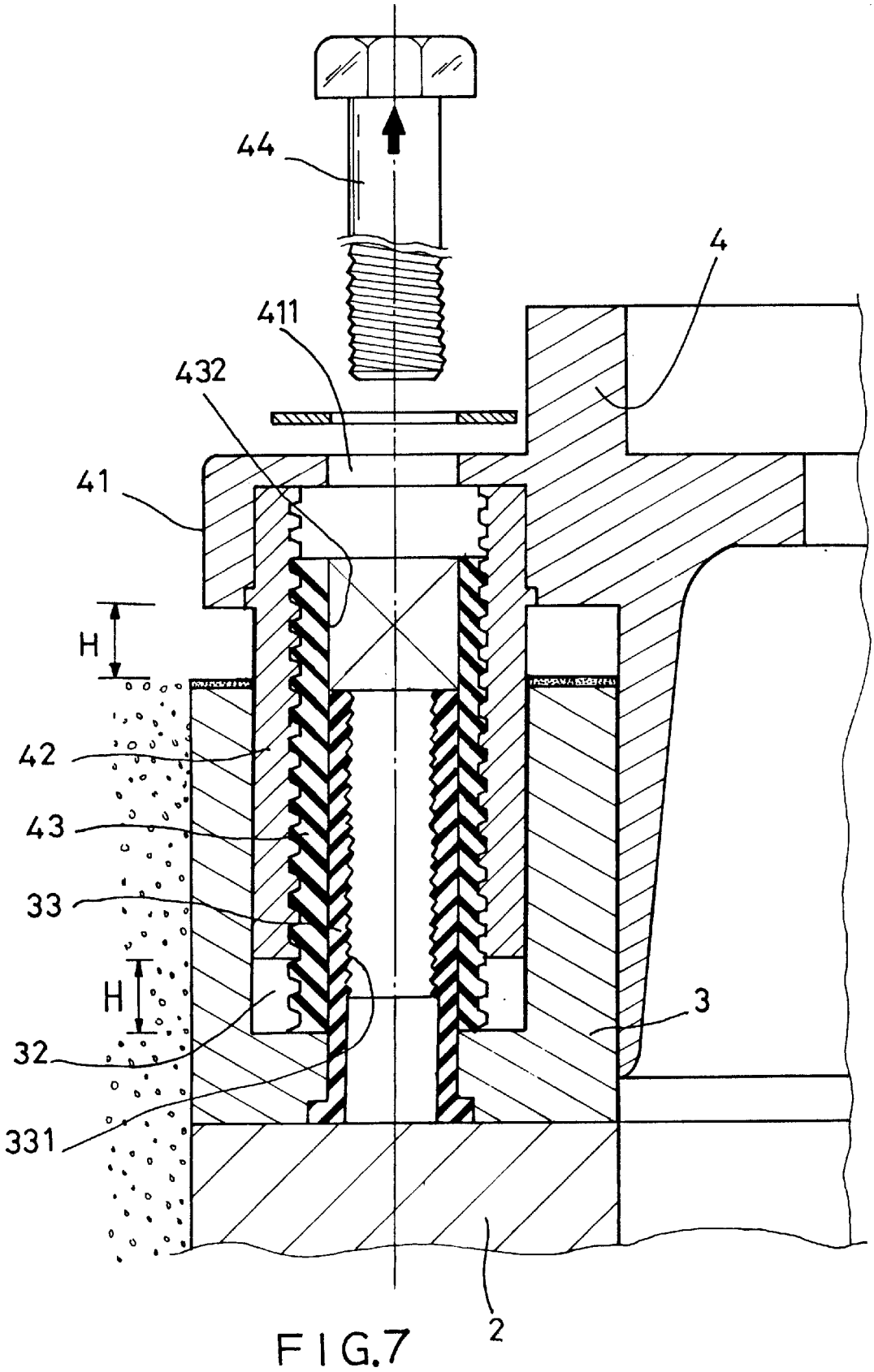
FIG. 7 illustrates the elevation of the inner frame adjusted relative to the outer frame according to the present invention.
Figure 8:
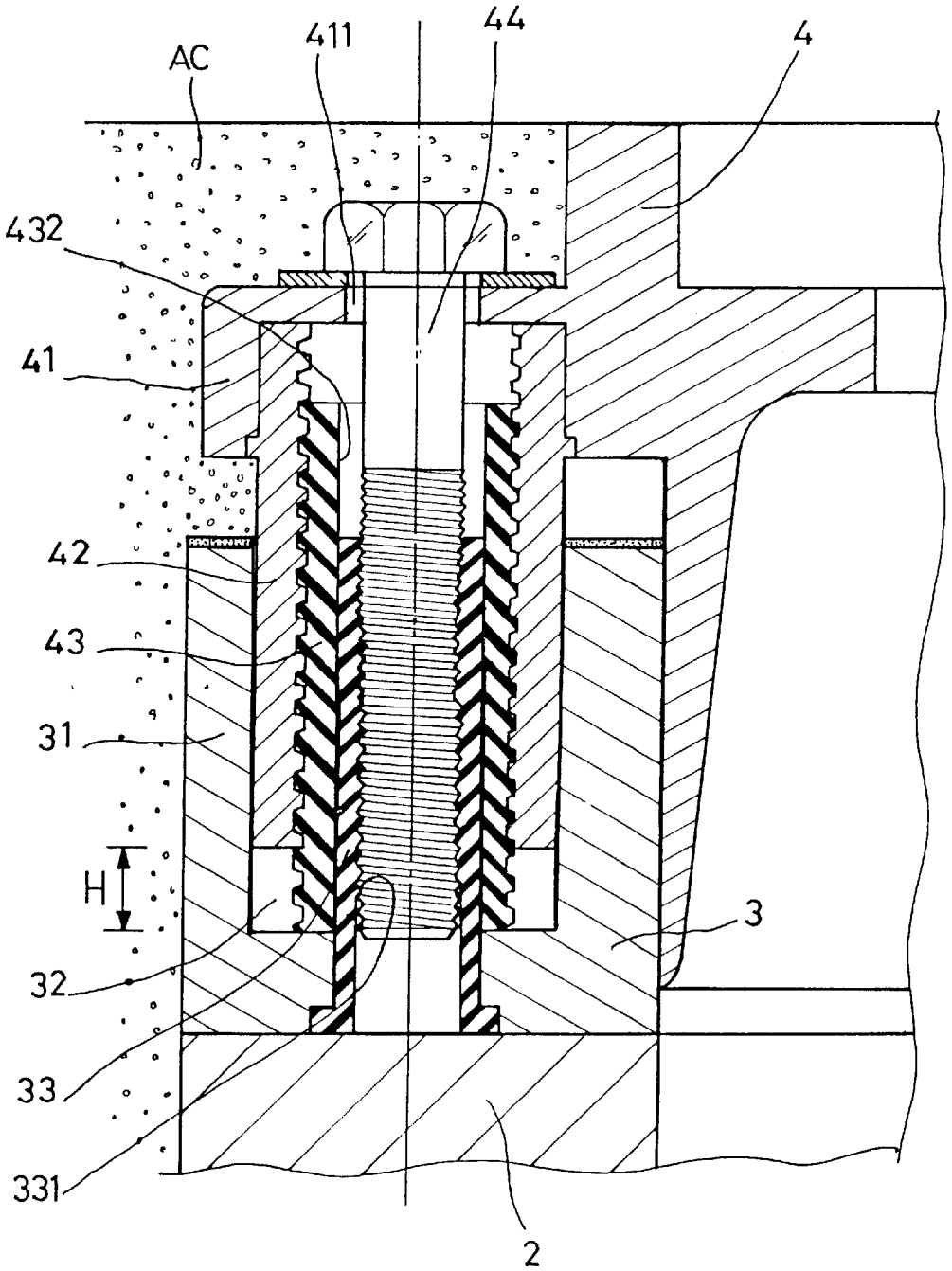
FIG. 8 illustrates the manhole cover mounting structure installed again after an elevation adjustment.

If the cover plate 5 sinks with the manhole box 2 under the pressure of vehicles passed, the through bolts 44 are removed from the inner frame 4 and the outer frame 3, and then a wrench (not shown) is used and inserted into the upper polygonal hole 432 to rotate each screw rod 43 upwards, so as to lift the inner frame 4 from the outer frame 3 to a certain height H, as shown in FIG. 7, keeping the cover plate 5 in flush with the road surface, and then the through bolts 44 are respectively threaded into the screw hole 331 of the upright guide rod 33 of each locating block 31 to secure the inner frame 4 to the outer frame 3 again, as shown in FIG. 8.

Figure 9:
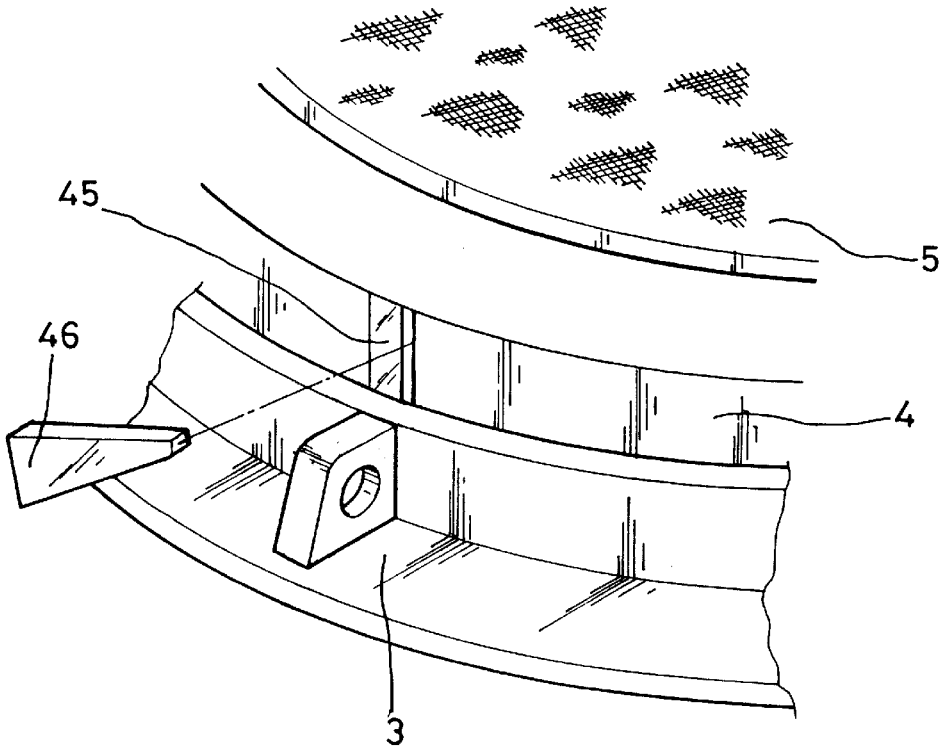
FIG. 9 illustrates the positioning of a wedge block in a through hole on the inner frame relative to the outer frame according to the present invention.
Figure 10:
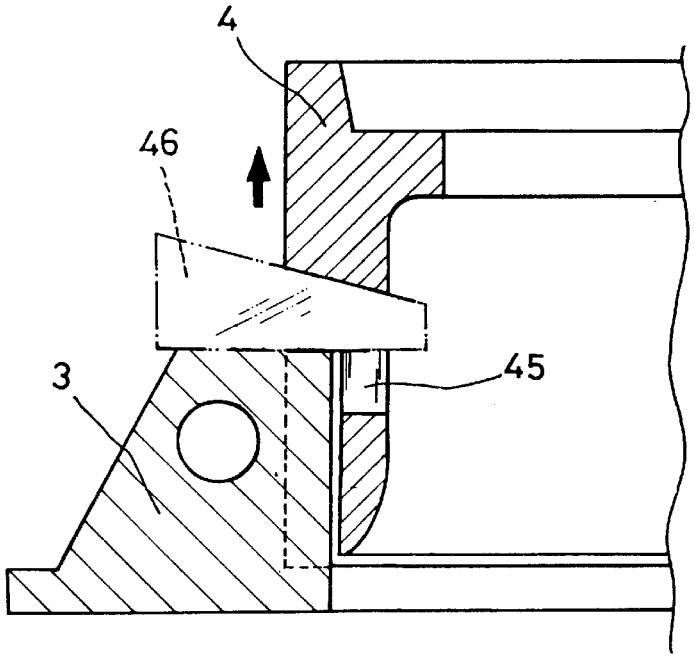
FIG. 10 is a sectional assembly view of FIG. 9.

Referring to FIGS. 9 and 10, the inner frame 4 has a plurality of through holes 45 spaced around the periphery, and wedge blocks 46 may be inserted into the through holes 45 and supported on the outer frame 3 to share the load at each screw rod 43, so as to ensure the service life of the manhole cover mounting structure.

Figure 11:
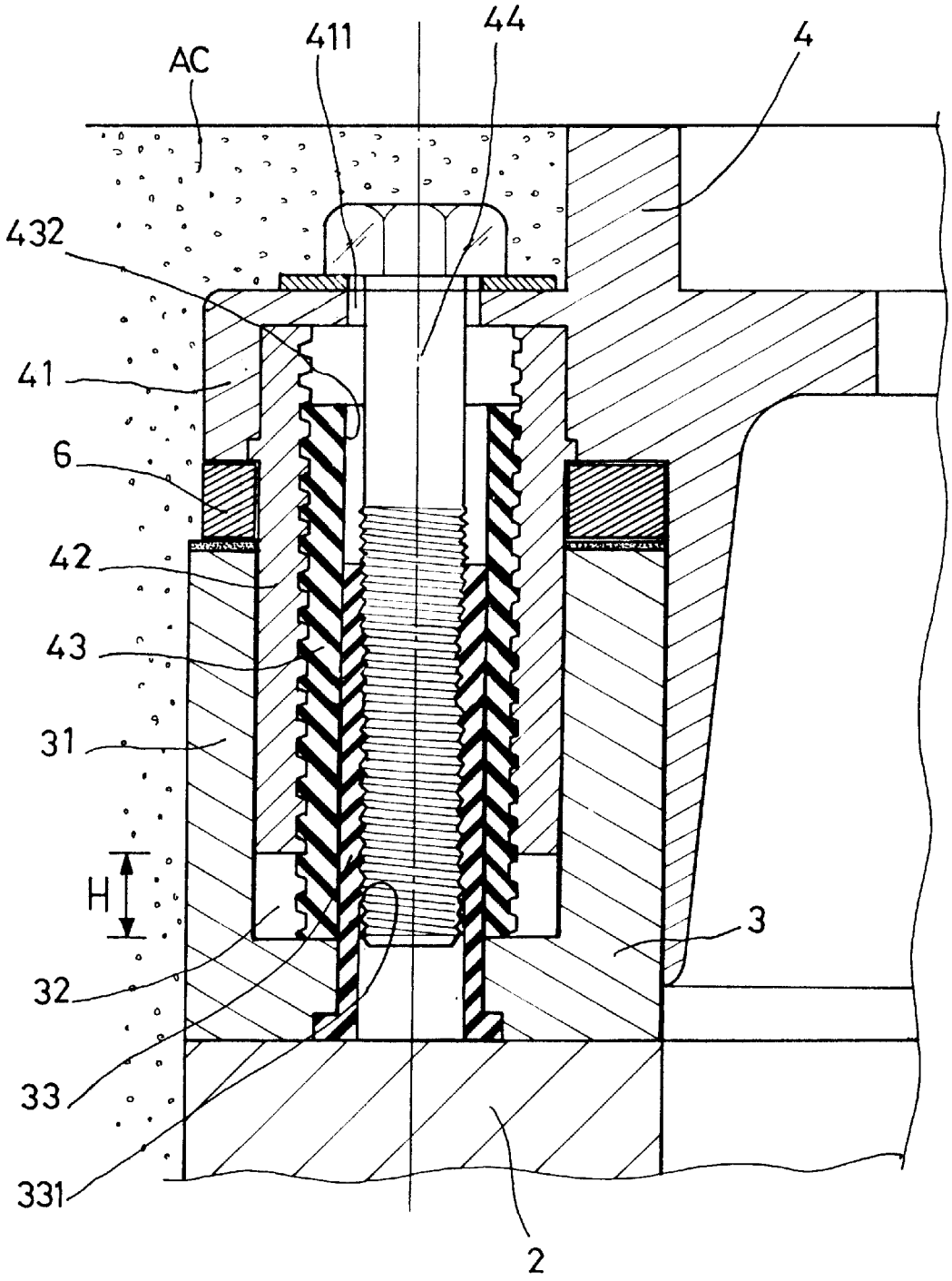
FIG. 11 illustrates a packing frame supported between the outer frame and the inner frame according to the present invention.

Referring to FIG. 11 and FIG. 3 again, a packing frame 6 may be installed and supported between the outer frame 3 and the inner frame 4 to adjust the elevation of the inner frame 4 relative to the outer frame 3.

As indicated above, the elevation of the cover plate 5 is adjusted by means of adjusting the position of the inner frame 4 relative to the inner frame 3. Further, the inner frame 4 can be tilted relative to the outer frame 3 to fit the sloping condition of the road surface, keeping the cover plate 5 in flush with the road surface. Because reinforcing concrete is not used and asphalt AC is covered on the manhole box 2 around the outer frame 3 and the inner frame 4, the manhole cover mounting structure has a nice look when installed. Furthermore, the invention is suitable for circular manholes, square manholes, rectangular manholes, or manholes of any of a variety of shapes.

A prototype of manhole cover mounting structure has been constructed with the features of FIGS. 3~11. The manhole cover mounting structure functions smoothly to provide all of the features discussed earlier.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A manhole cover mounting structure comprising:

a manhole box, said manhole box having a plurality of screw nuts fixedly provided at a topside thereof;

an outer frame fixedly fastened to screw nuts of said manhole box by screw bolts;

an inner frame mounted in said outer frame; and a cover plate covered on said inner frame in flush with the topmost edge of said inner frame;

wherein:

said outer frame comprises a plurality of locating blocks disposed around the periphery thereof, said locating blocks each comprising a top-open hollow body and an upright guide rod disposed in said hollow body, said upright guide rod having an axially upwardly extended screw hole;

said inner frame comprises a plurality of lugs spaced around the periphery thereof corresponding to the locating blocks of said outer frame, said lugs each having a through hole, a plurality of female screws respectively fixedly fastened to said lugs at a bottom side and axially aligned with the through hole of each of said lugs, and a plurality of screw rods respectively threaded into said female screws, said screw rods each having an axially extended, stepped through hole formed of an upper polygonal hole and a lower coupling hole, which receives the upright guide rod of each of the locating blocks of said outer frame;

a plurality of through bolts are respectively inserted into the upper polygonal hole and lower coupling hole of each screw rod at each of the lugs of said inner frame and threaded into the screw hole of the upright screw rod of each of the locating blocks of said outer frame to secure said inner frame to said outer frame.

2. The manhole cover mounting structure of claim 1 wherein said inner frame has a plurality of through holes spaced around the periphery thereof into which wedge blocks are selectively inserted and supported on said outer frame.

3. The manhole cover mounting structure of claim 1 further comprising at least one packing frame supported between said outer frame and said inner frame.

* * * * *